United States Patent [19]

Smith et al.

[11] 3,936,591

[45] Feb. 3, 1976

[54] NONMETALLIC-SHEATHED CABLE

[75] Inventors: Lambert C. Smith; Verne A. Meridith, both of Athens, Ga.; Robert M. Wade, Wabash, Ind.

[73] Assignee: The Anaconda Company, Mont.

[22] Filed: July 5, 1974

[21] Appl. No.: 486,042

[52] U.S. Cl. ..... 174/116; 174/110 F; 174/113 R; 174/115

[51] Int. Cl.[2] ..... H01B 11/02

[58] Field of Search ..... 174/110 F, 113 R, 115, 174/116

[56] References Cited

UNITED STATES PATENTS

| | | | |
|---|---|---|---|
| 2,973,552 | 3/1961 | Downing | 174/110 F |
| 3,013,109 | 12/1961 | Gorman et al. | 174/113 R |

*Primary Examiner*—E. A. Goldberg

*Attorney, Agent, or Firm*—Pennie & Edmonds

[57] ABSTRACT

Nonmetallic-sheathed cable is insulated and jacketed with expanded polyvinyl chloride comprising 8–24%, by volume, of gas.

6 Claims, 2 Drawing Figures

NONMETALLIC-SHEATHED CABLE

BACKGROUND OF THE INVENTION

Nonmetallic-sheathed cable is an art recognized designation for a power cable that is used for 600 volt service in buildings and, in accordance with the Electrical Codes of many localities, can be installed without conduit. Because conduit may be omitted, the cable must meet certain established requirements with reference to its resistance to crushing loads. It has been established that flat cables are more susceptible to crushing damage than round cables so that it is Underwriters' Laboratories practice to require crushing performance tests on flat nonmetallic-sheathed cables in the knowledge that insulation and sheathing materials and thicknesses which prove satisfactory for flat nonmetallic-sheathed cables will also be satisfactory for round nonmetallic-sheathed cables.

Underwriters' Laboratories edgewise crushing test for nonmetallic-sheathed cables require that a length of cable which includes a 180° twist be compressed between steel plates 2 inches long until the insulated conductors of the cable short circuit to each other or to one of the plates. Because of the 180° twist the effective crushing force is endwise. Underwriters' Laboratories flatwise crushing test for nonmetallic-sheathed cable compresses the flat surface of the cable against a ⅛ inch diameter rod. Two-conductor nonmetallic-sheathed cable, with or without a ground wire is conventionally made in a flat construction, with the conductors laid parallel and not twisted together, while three and four conductor nonmetallic-sheathed cable, which also may or may not include a ground wire, is conventionally made in a round construction. Conventional nonmetallic-sheathed cable, of which many millions of feet are in service, has solid polyvinyl chloride insulation on the conductors with minimum thicknesses increasing with conductor diameters as follows: Nos. 14-10 Awg (American Wire Gage), 30 mils; No. 8 Awg 45 mils; Nos. 6–2 Awg, 60 mils. Conventional extruded sheaths of nonmetallic-sheathed cable have also utilized polyvinyl chloride with an average wall thickness minima of thirty mils.

In U.S. Pat. No. 3,013,109 there was described a non-metallic-sheathed cable having conductors insulated with solid semirigid polyvinyl chloride which were embedded in a solid matrix of polyvinyl chloride expanded to have a gas content of 25 to 50%. The expanded matrix not only served as a sheath but entered between the conductors and filled all the available space. Largely because the conductors were protected by the dense, semirigid insulation walls this cable construction was able to meet Underwriters' Laboratories qualifications tests. Expanded insulation, as distinguished from expanded jacketing material, has been widely used for telephone conductors which operate at low voltages and are not subject to severe crushing. In telephone pair insulation the expanded compositions have the advantage over solid compositions of lower dielectric constants. British Pat. No. 742,760, published in 1956, illustrates a method of applying such expanded compositions to wire. Expanded insulation has also been widely used for video cable insulation, as disclosed in U.S. Pat. No. 2,805,276. In order to reduce the dielectric constant as much as possible, the gas content of such communication cable insulations is high, generally exceeding 25%.

SUMMARY

We have discovered that by controlling the gas content of polyvinyl chloride compositions within close limits economies of weight and cost can be achieved with the use of the expanded composition in both the insulation and jacket of nonmetallic-sheathed cable where the jacket does not project substantially between the conductors. Our new nonmetallic-sheathed cable comprises a plurality of copper or aluminum conductors, a wall of expanded polyvinyl chloride insulation surrounding each of the conductors and a thin-walled tubular jacket of polyvinyl chloride surrounding the totality of insulated conductors. The expanded insulation and expanded sheath comprise 8–24%, by volume, of gas. Our cable may advantageously comprise a total of two insulated conductors positioned in parallel and in addition may comprise an uninsulated grounding wire positioned between the conductors. Particular advantage accrues to our invention where the size of the conductors is between Nos. 14-2 Awg.

DETAILED DESCRIPTION OF PREFERRED EMBODIMENT

Figure 1:
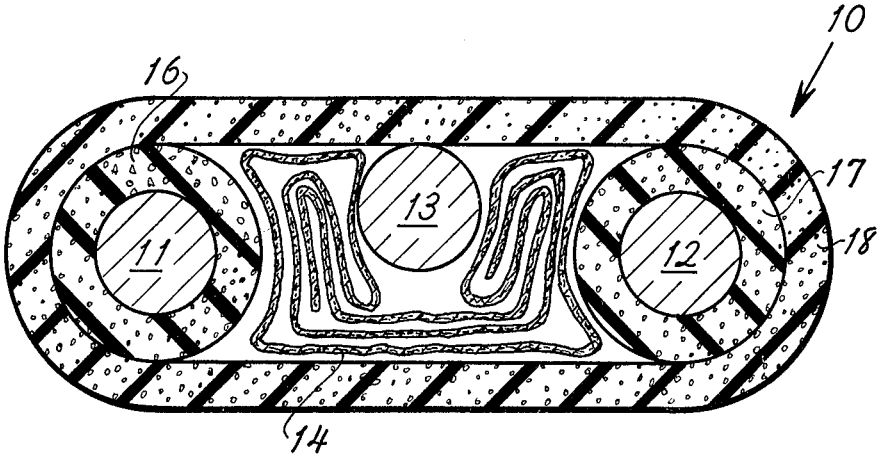
FIG. 1 shows a section of a two-conductor cable made to our invention.

In FIG. 1 there is shown a flat cable indicated generally by the numeral 10 having two parallel conductors 11, 12 of aluminum or copper and a grounding wire 13 selected from the same metals. A folded paper separator 14 is interposed between the grounding wire 13 and the conductors 11, 12. As shown, the wire 13 has the same sectional area as the wires 11, 12 but grounding wires having gages smaller than that of the conductors may also be used within the scope of our invention. An improved cable within the general type of FIG. 1 but with conventional solid insulation is described in application Ser. No. 444,929 filed Feb. 22, 1974 and assigned to the present assignee.

Insulating walls 16, 17 of expanded polyvinyl chloride insulation have been extruded over the respective conductors 11, 12. The thickness of the insulating walls do not differ substantially from the thickness of the walls of conventional solid insulation. For example, where the conductors 11, 12 are No. 12 Awg the walls 16, 17 are no less than 30 mils thick. An expanded polyvinyl chloride jacket 18 preferably of the same composition as the walls of insulation 11, 12 and having a thickness of about thirty-two mils has been extruded overall. The gas content of the insulation walls and jacket of the illustrated cable 10 was 11% by by volume. We have determined, however, that compositions with gas contents as high as 24% will provide the required protection including crush resistance. There is, however, no economy of material sufficient to compensate for the increased complexity of compounding and processing control where the gas content is appreciably lower than 8%. The porous structure of the expanded material is very fine, being generally imperceptible to the naked eye, and it is believed that this fine pore structure contributes to the resistance to crushing, hereinafter described, of the present cable.

A crush test was performed on the No. 12 Awg conductor cable of FIG. 1 having insulating walls and jacket extruded with a stock of the composition of the EXAMPLE. This crush test data appears in the TABLE below.

EXAMPLE

| | Parts by Weight |
|---|---|
| Polyvinyl chloride resin | 175.0 |
| calcium carbonate*** | 52.5 |
| calcined clay | 35.0 |
| stearic acid | 0.2 |
| stabilizer (lead silicate sulfate)* | 8.8 |
| plasticizer diisodecylphthalate | 74.0 |
| alkylated aromatic hydrocarbons** | 24.0 |
| blowing agent, (azodicarbonamide)**** | .11 |

*Tribase E-XL, supplied by National Lead Co., New York, N. Y.
**Panaflex BN-1, supplied by Panamerican Resin & Chemical Co., Newark, N. J.
***Atomite, supplied by Thompson, Weinman & Co., Cartersville, Ga.
****Celogen AZ-130, supplied by Uniroyal, New York, N. Y.

TABLE

| POUND LOAD TO FAILURE | | | |
|---|---|---|---|
| Edgewise Crushing Test | | Flatwise Crushing Test | |
| Clockwise | Counterclockwise | Top | Bottom |
| 1050 | 1180 | 820 | 840 |
| 1350 | 1420 | 800 | 840 |
| 1250 | 1180 | 620 | 850 |
| 1220 | 1210 | 890 | 880 |
| 1400 | 1460 | 950 | 630 |
| 1254 Avg. | 1290 Avg. | 816 Avg. | 808 Avg. |

Underwriters' Laboratories require a minimum average of 1200 pounds in the edgewise crushing test and 600 pounds in the flatwise crushing test.

Figure 2:
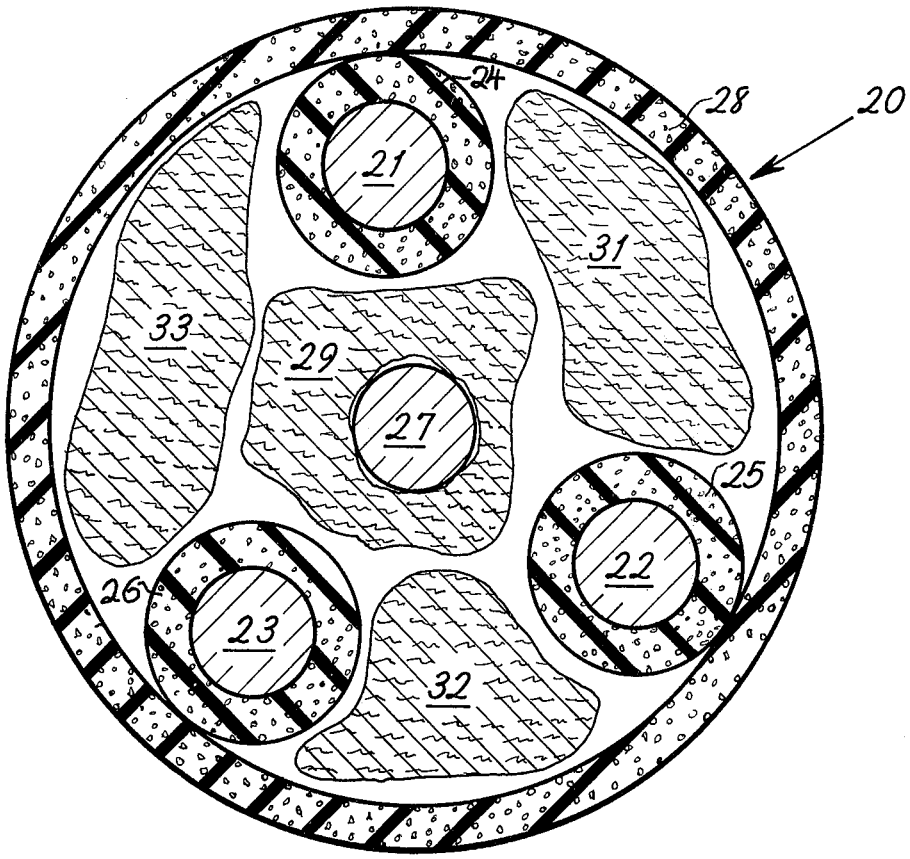
FIG. 2 shows a section of a three-conductor cable made to our invention.

In FIG. 2 we have shown a round cable, indicated generally by the numeral 20 having three conductors 21, 22, 23 insulated respectively by walls 24, 25, 26 of expanded polyvinyl chloride insulation of the same composition used for the cable of FIG. 1. The cable 20 may also be considered illustrative of a four conductor cable which will differ only by the inclusion of an additional insulated conductor. The conductors 21, 22, 23 are twisted together, creating valleys or interstices. With the conductors 21-23 there has been stranded a bare grounding wire 27 which we prefer to have the same diameter as the conductors 21, 22, 23. An extruded jacket 28 of the expanded polyvinyl chloride surrounds the insulated conductors and grounding wire overall. The grounding wire 27 is spaced from direct contact with the walls 24, 25 by layers of a paper separator 29 and additional such separators 31, 32, 33 or any conventional filler material is also applied to the interstices to give the cable a round configuration.

The jackets 18 and 28 are thin-walled, having uniform thicknesses throughout their perimeters not substantially exceeding a thickness of about 30–35 mils. This type of jacket is essentially different from that of the aforementioned patent 3,013,109 wherein the so-named sheath filled the entire section through the cable with the exception of close-fitting passages for the conductors. Since the most essential function of a jacket is that of mechanical protection, the present discovery that such protection is afforded by a thin-walled jacket of expanded polyvinyl chloride, was unexpected and has great technological significance in view of the present and continuing shortage of polyvinyl chloride supplies.

The composition of the EXAMPLE is not limiting for our invention. Particularly compositions with higher proportions of the resin are known for unexpanded application and may be used with some sacrifice of economy. Other possible plasticizers such as dialkyl adipate esters, dialkyl azelates, glycol dibenzoate esters, epoxidized soy bean oil, glycollates such as butyl phthalyl butyl glycollate, and other phosphate esters are known. Other blowing agents may also be used such as p,p'-oxybis (benzene-sulfonyl hydroxide), N,N'-dimethyl-N,N'-dinitrosoterephthalamide, and dinitrosopentamethylene tetramine. Indeed, it is known to expand polyvinyl chloride by means of dissolved pressurized gas in the absence of a blowing agent and this means can be practiced, too, within the scope of our invention. Other fillers such as diatomaceous earth, fumed silica, asbestos, etc, are also well known and may be used in lieu of or in addition to the calcium carbonate and calcined clay of the EXAMPLE.

The foregoing description, then, has been exemplary rather than definitive of our invention for which we desire an award of Letters Patent as defined in the following claims.

We claim:

1. A nonmetallic-sheathed cable comprising

A. a plurality of conductors comprising a metal selected from the group consisting of copper and aluminum, B. a wall of expanded polyvinyl chloride insulation surrounding each of said conductors, said wall comprising 8–24%, by volume, of gas, C. a thin-walled tubular jacket of expanded polyvinyl chloride surrounding the totality of said insulated conductors said jacket comprising 8–24%, by volume, of gas.

2. The cable of claim 1 comprising a total of two insulated conductors, positioned in parallel.

3. The cable of claim 2 further comprising an uninsulated grounding wire positioned between said conductors.

4. The cable of claim 1 wherein the size of said conductors is between the sizes of Nos. 14-2 Awg.

5. The cable of claim 1 comprising a total three insulated conductors, said conductors being twisted together.

6. The cable of claim 5 further comprising an uninsulated grounding wire surrounded by said jacket.

* * * * *